United States Patent [19]

Sorgatz

[11] 4,106,830

[45] Aug. 15, 1978

[54] ROTATABLE SUPPORT STAND

[76] Inventor: Robert G. Sorgatz, Chicago, Ill. 60656

[21] Appl. No.: 791,436

[22] Filed: Apr. 27, 1977

[51] Int. Cl.[2] ..... H01R 39/00

[52] U.S. Cl. ..... 339/8 R; 339/5 P; 339/34

[58] Field of Search ..... 339/8 R, 8 P, 5 P, 34, 339/101, 182 RS, 8 PB

[56] References Cited

U.S. PATENT DOCUMENTS

| | | | |
|---|---|---|---|
| 2,469,884 | 5/1949 | Masone | 339/5 P X |
| 2,866,956 | 12/1958 | Miller et al. | 339/34 |
| 3,189,862 | 6/1965 | Vleerick et al. | 339/34 |
| 3,652,972 | 3/1972 | Kreider | 339/8 PB |
| 3,701,073 | 10/1972 | Lale | 339/5 P |

*Primary Examiner*—Roy Lake
*Assistant Examiner*—DeWalden W. Jones
*Attorney, Agent, or Firm*—Bernard L. Kleinke

[57] ABSTRACT

A stand for supporting from below electrically energizable apparatus, includes a platform disposed above a base and adapted to support the apparatus. An electrical outlet is mounted on the platform for supplying electrical energy to the apparatus, and a power cord is connected to the base and is adapted to be coupled to a source of electrical energy. A bearing device in the form of ball bearings has a series of electrically conductive rollable bearing members or balls interposed between the platform and the base for supporting rollably the platform on the base to enable the platform to rotate freely about its vertical axis relative to the base in a continuous 360° path of rotation and for coupling electrical energy to the electrical outlet. Upper and lower stationary contact devices are disposed within the closed loop path of travel and are composed of electrically conductive material, the upper stationary contact device being attached to the underside of the platform and the lower stationary contact device being attached to the top surface of the base. A first pair of electrical conductor leads are connected electrically at one of their ends to the power cord, the other end of the conductor leads being connected individually and electrically to the lower bearing race of the bearing device and to the lower stationary contact device. A second pair of electrical conductor leads are connected individually and electrically at one of their ends to the upper bearing race of the bearing device and to the upper stationary contact device, the other ends of the second pair of electrical conductor leads being connected electrically to the outlet. Thus, the electrical apparatus to be supported can be electrically connected to the outlet, and the apparatus can then be rotated about a vertical axis in a continuous 360° manner indefinitely while being energized electrically.

10 Claims, 6 Drawing Figures

ROTATABLE SUPPORT STAND

The invention relates in general to a rotatable support stand, and more particularly relates to a stand adapted to support from below an electrically energizable apparatus.

Many different types and kinds of support stands have been known in the past. Some of the support stands have included turntables which enable the electrically energizable apparatus to be rotated about the vertical axis while being energized electrically without tangling the power cords. For example, reference may be made to the following U.S. Pat. Nos. 2,226,209; 2,469,884; 2,866,956; and 3,189,862. While such electrically energizable support stands have been satisfactory for some applications, it would be highly desirable to have such a support stand which operates in a convenient manner and which can be manufactured relatively inexpensively.

Therefore, the principal object of the present invention is to provide a new and improved support stand, which is adapted to support from below an electrically energizable apparatus, and which enables the apparatus to be rotated about its vertical axis in a continuous 360° path of travel while being electrically energized.

Another object of the present invention is to provide such a new and improved support stand which is convenient to use and which is relatively inexpensive to manufacture.

Briefly, the above and further objects of the present invention are realized by providing a support stand which includes a platform rotatably mounted on a base, and an electrical outlet mounted on the platform for supplying electrical energy to apparatus supported on the platform. A power line cord is connected to the base and is adapted to be coupled to a source of electrical energy. A bearing device having a series of electrically conductive rollable bearing members is interposed between the platform and the base for supporting rollably the platform on the base to enable the platform to rotate freely about its vertical axis relative to the base in a continuous 360° path of rotation and for coupling electrical energy to the electrical outlet. Upper and lower stationary contact devices are disposed within the closed loop path of travel and are composed of electrically conductive material. The upper stationary contact is attached to the underside of the platform, and the lower stationary contact is attached to the upper surface of the base. A first pair of electrical conductor leads are connected electrically at one of their ends to the power cord, and the other ends of the conductor leads are connected individually and electrically to the lower bearing race of the bearing device and to the lower stationary contact device. A second pair of electrical conductor leads are connected individually and electrically at one of their ends to the upper bearing race of the bearing device and to the upper stationary contact device, the other ends of the second pair of electrical conductor leads being connected electrically to the outlet so that the apparatus can be electrically energized while being rotated about its vertical axis.

The above, and still further highly important objects and advantages of the invention will become apparatus from the following detailed specification, appended claims and attached drawings, wherein:

Figures 1, 2, 3, 6:
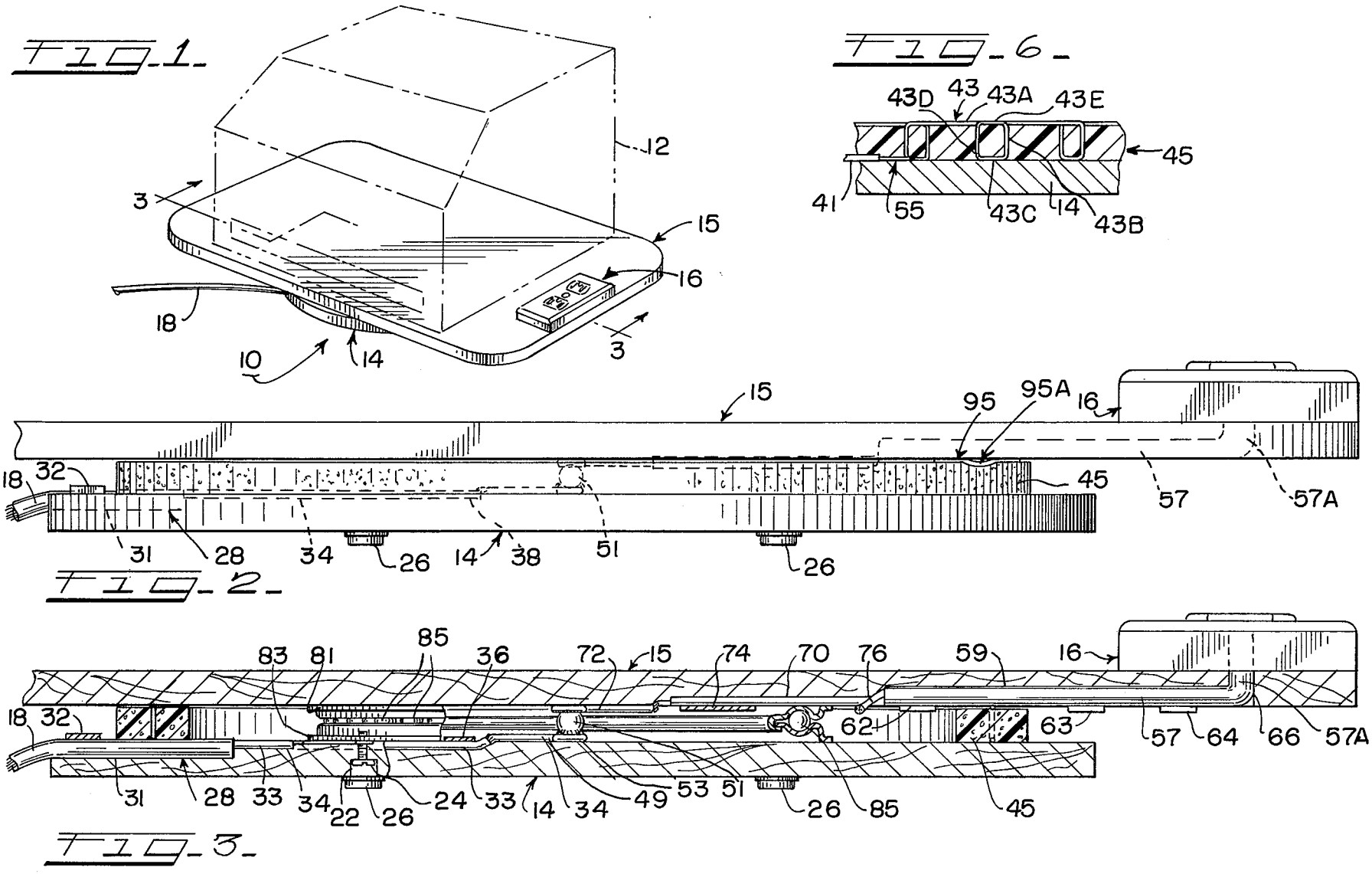
FIG. 1 is a pictorial view of a support stand, which is constructed in accordance with the present invention.
FIG. 2 is a fragmentary enlarged elevational view of the stand of FIG. 1.
FIG. 3 is a fragmentary cross-sectional view of the stand of FIG. 1 taken substantially along the line 3—3 thereof.
FIG. 6 is an enlarged detailed cross-sectional view of the stand of FIG. 1 illustrating the ground conductor thereof.

Referring now to the drawings, and more particularly FIG. 1 thereof, there is shown a support stand 10, which is constructed in accordance with the present invention, and which is adapted to support from below an electrically energizable apparatus 12. It is to be understood that the electrically energizable apparatus 12 may be any electrical apparatus, such as a micro fiche reader, television set, Christmas tree bearing electrical lights or any other suitable type of electrical apparatus which requires a stand and which can be rotated about is vertical axis.

The support stand 10 generally comprises a base 14 having a horizontal platform 15 rotatably mounted thereon. An electrical outlet 16 is mounted on the upper face of the platform 15 to supply electrical power to the apparatus 12, and an electrical power cord 18 is connected to the base 14 and is adapted to be connected at its opposite end (not shown) to a source of electrical power for energizing the outlet 16 as hereinafter described in detail. As shown in FIG. 3 of the drawing, a ball bearing unit 20 rotatably supports the platform 15 on the base 14 so that the platform can rotate about a vertical axis relative to the base 14 for positionally adjusting the apparatus 12. In this regard, the apparatus 12 and the platform 15 may be rotated about their vertical axis continuously through 360° or more since the apparatus 12 is energized by the outlet 16 mounted on and carried by the platform 15. The ball bearing unit 20 also electrically interconnects the outlet 16 with the power supply cord 18 as hereinafter described in greater detail. As a result, the platform 15 with the apparatus 12 being supported from below thereon can be rotated about its vertical axis in either direction indefinitely for 360° or more without tangling the power cord (not shown) for the apparatus 12, since the platform 15 can be rotated freely and independently of the base 14. As the outlet 16 moves with and is carried by the platform 15 relative to the base 14 and the power cord 18, the power cord 18 does not become tangled as hereinafter described in greater detail.

Figure 4:
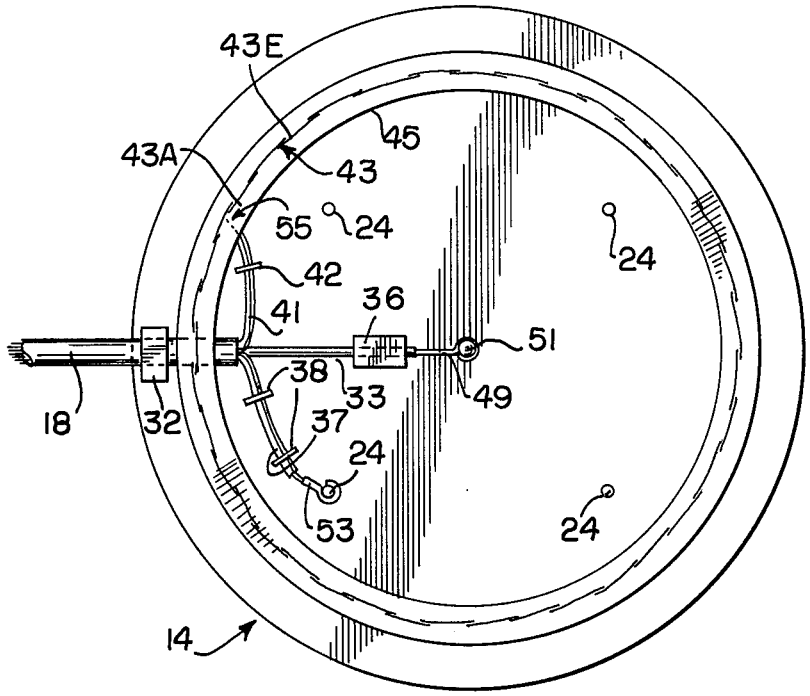
FIG. 4 is an enlarged face view of the stand of FIG. 1 with the platform thereof removed for illustration purposes.

Considering now the base 14 in greater detail with particular reference to FIGS. 2, 3 and 4 of the drawings, the base 14 is composed of wood and is generally circular in shape, but it is to be understood that various different shapes and configurations may be employed. A series of countersunk holes 22, as best seen in FIG. 3 of the drawings, receive a series of screws 24 to fix the ball bearing unit 20 to the base 14. A series of feet or pads 26 fit over the underside of the holes 22 to conceal them and to support the base 14 from the underside thereof on a supporting surface (not shown).

As best seen in FIGS. 2 and 3 of the drawings, a recess generally indicated at 28 in the upper face of the base 14 includes a deep portion 31 for at least partially receiving the power cord 18. A clip 32 fastens the power cord 18 to the base 14.

An electrical power conductor lead 33 of the power cord 18 is disposed within a shell or recess 34 of the recess 28, and is held in place by a clip 36 which fastens the lead 33 to the base 14. Another electrical power conductor lead 37 of the power cord 18 is secured to the upper surface of the base 14 by a plurality of smaller clips or staples 38 as best seen in FIG. 4 of the drawing. A ground conductor lead 41 of the power cord 18 is secured to the upper face of the base 14 by means of a small clip or staple 42.

An annular ground conductor 43 extends in a circle as best seen in FIG. 4 of the drawing, and is disposed within an annular foam strip 45, which is composed of suitable resilient material, such as foam plastic material. The strip 45 serves as an insulator for the conductor 43, and it also serves to protect the electrical connections all disposed within and surrounded by the strip 45 as will become apparent during the hereinafter included description.

As best seen in FIG. 4 of the drawings, a terminal 49 is electrically connected to the end of the lead 33 and is attached to and surrounds a fixed spherical contact 51 attached to the upper face of the base 14 at the center thereof. A terminal 53 is electrically connected to the end of the power lead 37 and surrounds and is fixed to the metallic screw 24 for electrically connecting the terminal 49 to the ball bearing unit 20. The lead 41 is connected at 55 to the annular ground conductor 43 by any suitable technique, such as soldering.

Figure 5:
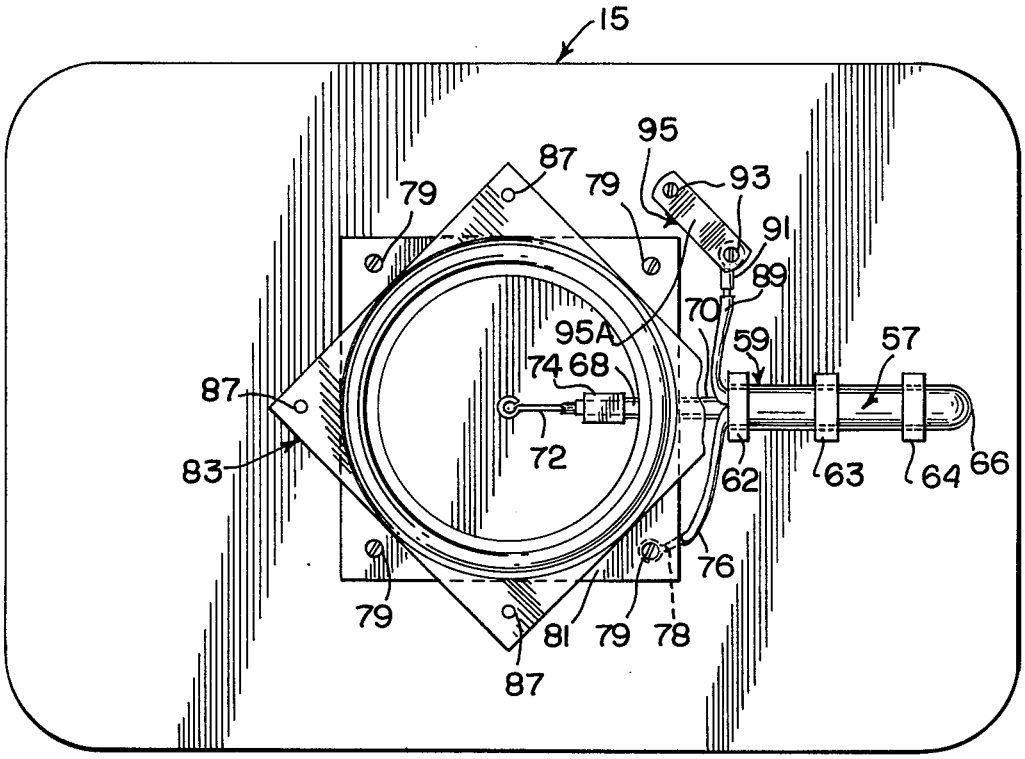
FIG. 5 is an enlarged face view of the underside of the platform of the stand of FIG. 1.

Considering now the platform 15 in greater detail with reference to FIGS. 2, 3 and 5 of the drawings, the platform is generally rectangular in shape and is composed of wood material. A length of power cord 57 is disposed within a recess 59 in the underside of the platform 15. A series of clips, such as the clips 62, 63 and 64, fix the power cord 59 to the underside of the platform 15.

A hole 66 extends through the platform 15 and forms a part of the recess 59 on the underside of the platform 15 so that a vertical upwardly extending portion 57A of the power cord 57 extends upwardly into the outlet 16. The three-conductor power cord 57 is connected to the outlet 16 in a conventional manner.

A power conductor lead 68 of the power cord 57 is disposed entirely within a recess 70 in the underside of the platform 15. A terminal 72 is electrically connected to the end of the lead 68, and a clip 74 fixes the lead 68 to the underside of the platform 15. A power conductor lead 76 of the cable 57 has an electrical terminal 78 electrically connected to and surrounding snugly one of the screws 79 fixing the corners of the upper race plate 81 of the ball bearing unit 20 to the underside of the platform 15 to electrically connect the power conductor lead 76 to the upper race plate 81 which is composed of conductive material, such as metal. A lower race plate 83 of the ball bearing unit 20 cooperates with the upper race plate 81 and has a series of metallic ball bearings 85 rollably disposed therebetween to support rollably the upper race plate 81 on the lower race plate 83 and to interconnect them electrically. A series of holes 87 in the corner portions of the lower race plate 83 cooperate and receive the screws 24 to fix the lower race plate 83 to the base 14.

A ground conductor 87 of the three-conductor cable 57 has electrically connected to the end portion thereof an electrical terminal 91 which surrounds snugly one of a pair of screws 93 fixing the opposite ends of a conductor strip 95 to the underside of the platform 15 in a position to engage electrically the annular ground conductor 43 as it moves relative to the contact strip 95 carried by the platform 15.

The annular conductor 43 extends in a ring on the upper surface of the foam strip 45. The conductor 43 is threaded through the strip 45 as best seen in FIG. 6 of the drawings to secure the annular ground conductor 43 to the foam strip 45. The strip 45 extends between the base 14 and the platform 15 to seal them for preventing or at least minimizing dust particles from entering the ball bearings and the other parts disposed within the annular strip 45.

The ground conductor 43 extends along the strip 45 and is sewn thereto at equally spaced-apart points along the strip 45 to form a series of loops. As best seen in FIG. 6 of the drawings, one of the loops includes a first forwardly extending upward portion 43A on the upper surface of the strip 45, a downwardly extending portion 45B disposed in and extending through the strip 45, a backwardly extending portion 43C on the lower surface of the strip 45, an upwardly extending portion 43D disposed in and extending through the strip 45, and a second forwardly extending upper portion 43E parallel to the other upper portion 43A. As a result, the portions 43A and 43E serve to provide a continuous ring of uninsulated conductor material for engaging the depending bowed intermediate portion 95A (FIG. 2 and FIG. 5) of the contact 95 fixed to the underside of the movable platform 15. The width of the bowed portion 95A is substantially greater than the diameter of both of the portions 43A and 43E of the conductor 43. Thus, the bowed intermediate portion 95A of the contact 95 is disposed in electrical contact with the portions 43A and 43E of the ground conductor 43 as the contact 95 is carried in a circular path of travel by the platform 15 as it is rotated about its vertical axis relative to the base 14 which has the stationary conductor 43 fixed on the upper surface thereof.

Considering now the operation of the support stand 10, the apparatus 12 is positioned on the upper surface of the platform 15, and the power cord (not shown) for the apparatus 12 is electrically plugged into the outlet 16 on the upper face of the platform 15. The power cord 18 is then connected electrically to a source of electrical energy. The apparatus 12 can then be energized electrically and it can be rotated about its vertical axis to adjust its angular position while continuing uninterruptedly to energize it electrically.

The electrical energy is supplied to the apparatus 12 from the power cord 18 which has its conductor 33 connected electrically to the fixed conductor 51 at the center of the base 14. The conductor 51 is connected electrically to the terminal 72 of the conductor 68 of the power cord 57 which, in turn, is connected electrically to the outlet 16. The other power conductor 37 of the cable 18 is connected electrically to the lower race plate 83 of the ball bearing unit 20, and the electrically conductive metal ball bearings 85 connect electrically the lower race plate 83 to the upper race plate 81, which, in turn, is connected electrically to the power conductor 76 of the cable 57. Thus, the conductor lead 76 is also connected electrically to the outlet 16 to complete the electrical circuit to the outlet 16 and in turn to the apparatus 12. Thus, as the platform 15 is moved about its vertical axis relative to the base 14, the upper race plate 81 rotates to the lower race plate 83 and the electrical current flows between the upper and lower race plates through the ball bearings. Thus, the ball bearing unit serves the dual function of both supporting rotatably the platform 15 on the base 14 and completing the electrical circuit for the outlet 16 to the power cord 18.

The ground conductor 41 of the cable 18 is connected electrically directly to the annular ground conductor 43 disposed between the platform 15 and the base 14. The contact 93 is connected electrically and movably slides along the annular conductor 43 as the platform 15 rotates about its vertical axis relative to the base 14. The conductor 93 is connected electrically to the ground conductor 89 of the cord 57 for the outlet 16, thereby completing the ground circuit for the outlet 16.

While the present invention has been described in connection with a particular embodiment thereof, it will be understood that many changes and modifications of the invention may be made by those skilled in the art without departing from the true spirit and scope thereof. For example, the shape of the platform 15 may assume any desired shape, such as a square or round shape. Accordingly, the appended claims are intended to cover all such changes and modifications as fall within the true spirit and scope of the present invention.

What is claimed is:

1. A support stand for electrically energizable apparatus, comprising:

a base;

a platform disposed above said base and adapted to support the apparatus;

a grounded electrical outlet mounted on said platform for supplying electrical energy to the apparatus;

power line means connected to said base and adapted to be coupled to a source of electrical energy and to ground potential;

bearing means having a series of electrically conductive rollable bearing members being circular in cross section and being interposed between said platform and said base for supporting rollably said platform on said base to enable said platform to rotate freely about its vertical axis relative to said base in a continuous 360° path of rotation and for coupling electrical energy to said electrical outlet, said bearing means including an upper bearing race fixed to the underside of said platform and composed of electrically conductive material for engaging said members, and a lower bearing race fixed to the top surface of said base opposite said upper race and composed of electrically conductive material for engaging said bearing members to guide said bearing race along a continuous first closed loop path of travel relative to the stationary lower bearing race;

upper and lower stationary contact means disposed within said closed loop path of travel and composed of electrically conductive material, said upper stationary contact means being attached to the underside of said platform and said lower stationary contact means being attached to the top surface of said base of said platform;

a first pair of electrical conductor leads connected electrically at one of their ends to said power line means, the other ends of said conductor leads being connected individually and electrically to said lower bearing race and to said lower stationary contact means;

a second pair of electrical conductor leads connected individually and electrically at one of their ends to said uper bearing race and to said upper stationary contact means, the other ends of said second pair of electrical conductor leads being connected electrically to said outlet; and ground conductor means mounted between said base and said platform and extending through a second closed loop enclosing the first closed loop, said conductor means including a stationary closed loop conductor and moving electrical contact means for contacting continuously said closed loop conductor to couple said electrical outlet to said power line means.

2. A support stand according to claim 1, wherein said conductor means extends in the second closed loop path in a plane disposed between said platform and said base, said closed loop conductor being fixed to one of said platform and said base, said electrical contact mounted to the other one of said platform and said base for engaging in electrical moving connection with said closed loop conductor, a first ground conductor lead electrically interconnecting said power line means and one of said ground conductor and said contact, a second ground conductor lead interconnecting electrically said outlet and the other one of said ground conductor and said contact.

3. A support stand according to claim 2, further including a strip composed of insulating material and extending in a closed loop path in a plane disposed between said platform and said base in engagement with said ground conductor means.

4. A support stand for electrically energizable apparatus, comprising:

a base;

a platform disposed above said base and adapted to support the apparatus;

an electrical outlet mounted on said platform for supplying electrical energy to the apparatus;

power line means connected to said base and adapted to be coupled to a source of electrical energy;

bearing means having a series of electrically conductive rollable bearing members interposed between said platform and said base for supporting rollably said platform on said base to enable said platform to rotate freely about its vertical axis relative to said base in a continuous 360° path of rotation and for coupling electrical energy to said electrical outlet, said bearing means including an upper bearing race fixed to the underside of said platform and composed of electrically conductive material for engaging said members, and a lower bearing race fixed to the top surface of said base opposite said upper race and composed of electrically conductive material for engaging said bearing members to guide them along a continuous closed loop path of travel;

upper and lower stationary contact means disposed within said closed loop path of travel and composed of electrically conductive material, said upper stationary contact means being attached to the underside of said platform and said lower stationary contact means being attached to the top surface of said base of said platform;

a first pair of electrical conductor leads connected electrically at one of their ends to said power line means, the other ends of said conductor leads being connected individually and electrically to said lower bearing race and to said lower stationary contact means;

a second pair of electrical conductor leads connected individually and electrically at one of their ends to said upper bearing race and to said upper stationary contact means, the other ends of said second pair of electrical conductor leads being connected electrically to said outlet;

a ground conductor extending in a closed loop path in a plane disposed between said platform and said base and being fixed to one of them;

an electrical contact mounted to the other one of said platform and said base for engaging in electrical moving connection with said conductor;

a first ground conductor lead electrically interconnecting said power line means and one of said ground conductor and said contact;

a second ground conductor lead interconnecting electrically said outlet and the other one of said ground conductor and said contact; and a strip composed of insulating material and extending in a closed loop path in a plane disposed between said platform and said base in engagement with said ground conductor, said ground conductor being sewn through said strip insulating material.

5. A support stand according to claim 4, wherein said ground conductor extends along said strip in its closed loop path, the last-mentioned path including a series of smaller closed loops disposed in planes transverse to the plane of said strip.

6. A support stand according to claim 5, wherein each one of said smaller loops includes a first forwardly extending upper portion of the upper surface of said strip, a downwardly extending portion disposed in said strip, a backwardly extending portion on the lower surface of said strip, an upwardly extending portion disposed in said strip and a second forwardly extending upper portion.

7. A support stand according to claim 3, wherein said strip surrounds said bearing means and extends between said platform and said base to serve as a protector for said bearing means.

8. A support stand according to claim 2, wherein said rollable bearing members are each ball bearings composed of electrically conductive material to complete an electrical connection between said upper bearing race and said lower bearing race.

9. A support stand according to claim 8, wherein said power line means includes a grounded power cord.

10. A support stand for electrically energizable apparatus, comprising:

a base;

a platform disposed above said base and adapted to support the apparatus;

an electrical outlet mounted on said platform for supplying electrical energy to the apparatus;

power line means connected to said base and adapted to be coupled to a source of electrical energy;

bearing means having a series of electrically conductive rollable bearing members interposed between said platform and said base for supporting rollably said platform on said base to enable said platform to rotate freely about its vertical axis relative to said base in a continuous 360° path of rotation and for coupling electrical energy to said electrical outlet, said bearing means including an upper bearing race fixed to the underside of said platform and composed of electrically conductive material for engaging said members, and a lower bearing race fixed to the top surface of said base opposite said upper race and composed of electrically conductive material for engaging said bearing members to guide them along a continuous closed loop path of travel;

upper and lower stationary contact means disposed within said closed loop path of travel and composed of electrically conductive material, said upper stationary contact means being attched to the underside of said platform and said lower stationary contact means being attached to the top surface of said base of said platform;

a first pair of electrical conductor leads connected electrically at one of their ends to said power line means, the other ends of said conductor leads being connected individually and electrically to said lower bearing race and to said lower stationary contact means;

a second pair of electrical conductor leads connected individually and electrically at one of their ends to said upper bearing race and to said upper stationary contact means, the other ends of said second pair of electrical conductor leads being connected electrically to said outlet;

a ground conductor extending in a closed loop path in a plane disposed between said platform and said base and being fixed to one of them;

an electrical contact mounted to the other one of said platform and said base for engaging in electrical moving connection with said conductor;

a first ground conductor lead electrically interconnecting said power line means and one of said ground conductor and said contact;

a second ground conductor lead interconnecting electrically said outlet and the other one of said ground conductor and said contact; and said ground conductor extending along said strip in its closed loop path, the last-mentioned path including a series of smaller closed loops disposed in planes transverse to the plane of said strip.

* * * * *